US008328443B2

(12) United States Patent
Kawabe et al.

(10) Patent No.: US 8,328,443 B2
(45) Date of Patent: Dec. 11, 2012

(54) PRINTER AND ROLL PAPER HOLDING MECHANISM

(75) Inventors: Yuichiro Kawabe, Shizuoka (JP); Osamu Watanabe, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 585 days.

(21) Appl. No.: 12/607,340

(22) Filed: Oct. 28, 2009

(65) Prior Publication Data

US 2010/0111586 A1 May 6, 2010

(30) Foreign Application Priority Data

Oct. 31, 2008 (JP) ..... 2008-282430

(51) Int. Cl.
*B41J 15/00* (2006.01)
*B41J 15/04* (2006.01)

(52) U.S. Cl. ..... 400/613; 400/611; 242/597

(58) Field of Classification Search ..... 400/613, 400/611, 614, 692, 693; 242/599, 597, 578, 242/597.1, 597.8; *B65H 16/06, 16/02, 23/08, B65H 23/18, 23/035; B41J 15/04*
See application file for complete search history.

(56) References Cited

U.S. PATENT DOCUMENTS

| | | | | |
|---|---|---|---|---|
| 7,037,014 | B2 * | 5/2006 | Clayvon et al. | 400/613 |
| 2010/0202817 | A1 * | 8/2010 | Shishido | 400/613 |

FOREIGN PATENT DOCUMENTS

| | | | |
|---|---|---|---|
| JP | 431763 | | 3/1992 |
| JP | 636851 | | 5/1994 |
| JP | 2001-192153 | * | 7/2001 |
| JP | 2001-335199 | | 12/2001 |
| JP | 2006232474 | | 9/2006 |
| JP | 2006232490 | | 9/2006 |
| JP | 2007-161456 | | 6/2007 |

OTHER PUBLICATIONS

Japanese Office Action dated Sep. 7, 2010 corresponding to U.S. Appl. No. 12/607,340, filed Oct. 28, 2009.

* cited by examiner

*Primary Examiner* — Ren Yan
*Assistant Examiner* — Marissa Ferguson Samreth
(74) *Attorney, Agent, or Firm* — Turocy & Watson, LLP

(57) ABSTRACT

A sidewall supports, in a cantilever state, a sheet holding shaft for holding a label sheet wound in a roll shape and positions a first end face, which is one end face, of the label sheet inserted over the sheet holding shaft. A roll paper holding mechanism that presses a second end face, which is the other end face, of the label sheet, has a first arm, a second arm, and a spring. The first arm projects from the sidewall and rotatably supports the second arm at an end thereof. The spring connects the first arm and the second arm and urges and pulls the second arm. The second arm comes into contact with the second end face of the label sheet in a process of being pulled to rotate and holds the label sheet in conjunction with the sidewall functioning as a reference plane.

14 Claims, 14 Drawing Sheets

PRINTER AND ROLL PAPER HOLDING MECHANISM

CROSS REFERENCE TO RELATED APPLICATION

This application is based upon and claims the benefit of priority from Japanese Patent Application No. P2008-282430 filed on Oct. 31, 2008, the content of which is incorporated herein by reference.

TECHNICAL FIELD

The present invention relates to a printer that stores therein roll paper wound in a roll shape and draws out the roll paper to perform printing and a roll paper holding mechanism used in such a printer.

BACKGROUND

Roll paper often used in a printer may skew when the roll paper is drawn out. Therefore, in the past, the printer that uses the roll paper regulates the movement of end faces of the roll paper to prevent the skew of the roll paper.

JP-A-2007-161456 discloses, as an example of the prevention of the skew of the roll paper, skew correcting means for pressing a side of the roll paper in a width direction of the roll paper. The skew correcting means presses a winding outer pressing member having a flat surface against the side of the roll paper using two skew correcting springs (see paragraphs 0062 to 0063 and FIG. 12).

Another example of the prevention of the skew of the roll paper is a method of using a label fastener 901 shown in FIG. 14. The label fastener 901 is a bent metal bar and has a U-shaped contact section 904 that comes into contact with an end face of the roll paper and inserting sections 905 that project in an orthogonal direction with respect to the contact section 904. A support shaft 902 for the roll paper has, on an outer circumferential surface thereof, a pair of grooves 903 extending in an axis direction. After inserting the roll paper over the support shaft 902, the label fastener 901 is set by fitting the inserting sections 905 in the grooves 903 of the support shaft 902 and pushing in the inserting sections 905. When the label fastener 901 is set, since the contact section 904 comes into contact with the end face of the roll paper, the label fastener 901 can regulate the movement in the width direction of the roll paper.

In the skew correcting means disclosed in JP-A-2007-161456, a movable range of the outer pressing member depends on a stroke of the skew correcting springs. Therefore, it is difficult for the skew correcting means to cope with plural kinds of roll paper having different widths.

In the label fastener 901 shown in FIG. 14, it is difficult to set tightening force of the inserting sections 905 applied to the support shaft 902. Specifically, when the tightening force of the inserting sections 905 applied to the support shaft 902 is too strong, it is difficult to attach the label fattener 901 to and detach the label fastener 901 from the support shaft 902. In this case, if an operator strongly pushes in the label fastener 901, this likely causes a rotation failure of the roll paper. Conversely, if the tightening force of the inserting sections 905 applied to the support shaft 902 is too weak, the label fastener 901 is pushed by the roll paper, which is about to move in the width direction, and moves.

SUMMARY

It is an object of the present invention to prevent a skew of roll paper with a simple structure.

According to an aspect of the present invention, there is provided a printer including: a sheet holding unit configured to have a reference plane for positioning a first end face of roll paper and rotatably hold the roll paper according to an end face reference by the reference plane; a conveying unit configured to draw out the roll paper held by the sheet holding unit and guide and convey the roll paper along a predetermined guide path; a printing unit configured to apply printing based on print data to the roll paper guided and conveyed through the guide path; a contact body configured to have a contact section and to be rotatably provided with the contact section located on a free end side, the contact section coming into contact with a second end face of the roll paper held by the sheet holding unit; and an urging unit configured to urge the contact body in a first rotating direction for bringing the contact section close to the second end face of the roll paper and bring the contact section into contact with the second end face to bring the first end face of the roll paper into contact with the reference plane.

According to another aspect of the present invention, there is provided a roll paper holding mechanism including: a contact body configured to have a contact section and to be rotatably provided with the contact section located on a free end side, the contact section coming into contact with a second end face of roll paper held by a sheet holding unit of a printer, which has a reference plane for positioning a first end face of the roll paper, according to an end face reference by the reference plane; and an urging unit configured to urge the contact body in a first rotating direction for bringing the contact section close to the second end face of the roll paper and bring the contact section into contact with the second end face to bring the first end face of the roll paper into contact with the reference plane.

DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION

An embodiment of the present invention is explained below with reference to FIGS. 1 to 9.

Figure 1:
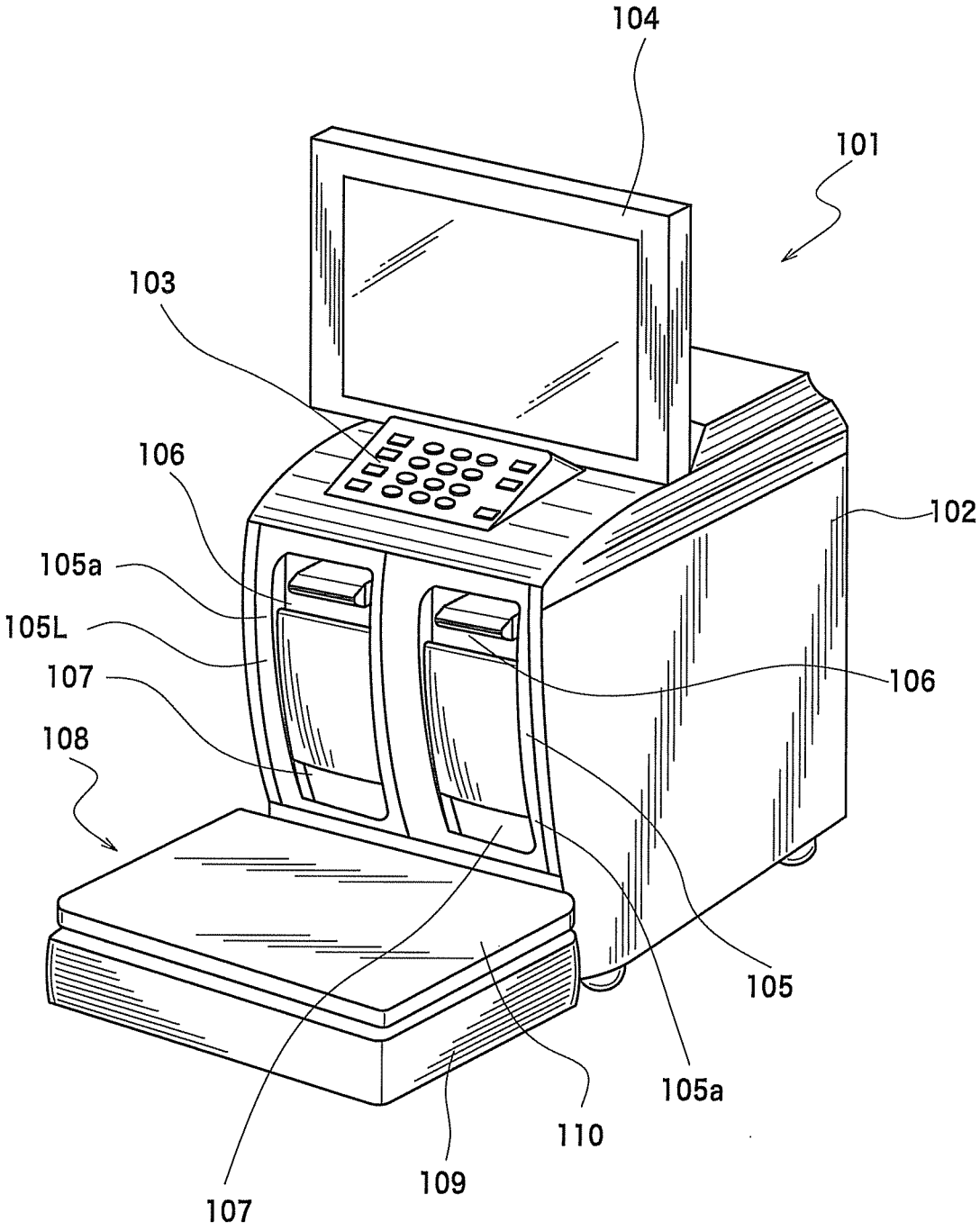
FIG. 1 is an external perspective view of a printer.

FIG. 1 is an external perspective view of a printer 101. The printer 101 includes a housing 102 of a substantially rectangular parallelepiped shape. The housing 102 has arranged on a top surface thereof an operation panel 103 including various keys such as a ten key and a display 104 as a display unit having a liquid crystal display. The housing 102 has an opening formed on a front side thereof. The housing 102 houses two print units 105 and 105L, which function as roll paper housing units, side by side in the inside thereof. Both the print units 105 and 105L have front panels 105*a* on front surfaces thereof. The front panels 105*a* have issue ports 106 opened in upper parts thereof. The front panels 105*a* have grips 107 in lower parts thereof. The housing 102 holds both the print units 105 and 105L to be freely drawn out and housed in a front direction. An operator can draw out the print units 105 and 105L from the housing 102 gripping the grips 107.

In FIG. 1, an apparatus arranged in front of and adjacent to the printer 101 is a measuring apparatus 108. The measuring apparatus 108 includes a flat main body apparatus 109 and a measuring plate 110 attached to a top surface of the main body apparatus 109. The main body apparatus 109 has a function of measuring the weight of an article placed on the measuring plate 110 and outputting measurement data of the weight. The printer 101 is electrically connected to the measuring apparatus 108. The measuring apparatus 108 inputs the output measurement data to the printer 101.

Figure 2:
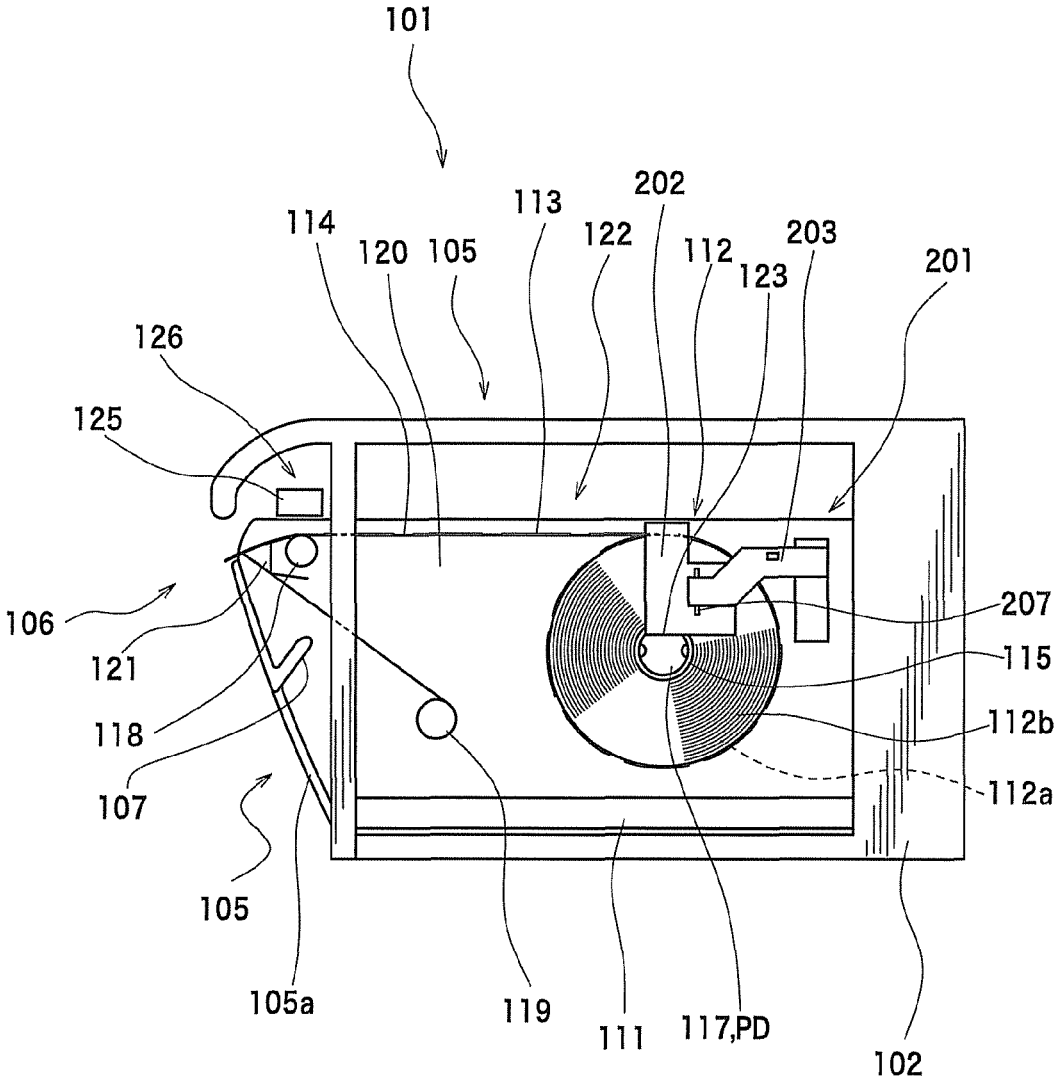
FIG. 2 is a schematic longitudinal sectional side view of the printer in a state in which a print unit is housed in a housing.

FIG. 2 is a schematic longitudinal sectional side view of the printer 101 in a state in which the print unit 105 is housed in the housing 102. In FIG. 2, of the two print units 105 and 105L, one print unit 105 located on the right viewed from the front side of the printer 101 is shown. The other print unit 105L located on the left is symmetrical to the print unit 105 shown in FIG. 2. Only the print unit 105 located on the right is explained below. Explanation of the print unit 105L located on the left is omitted.

In this embodiment, a label sheet 112 used in the print unit 105 is roll paper wound in a roll shape. The label sheet 112 is formed by linearly sticking plural labels 113 on an elongated base sheet 114 and winding the base sheet 114 around a paper pipe 115 in a roll shape. As the labels 113, thermo-sensitive labels that develop colors according to heating are used.

The print unit 105 includes a sheet holding shaft 117, a platen 118, and a base-sheet winding shaft 119. The paper pipe 115 is inserted over the sheet holding shaft 117 to hold the label sheet 112. The base-sheet winding shaft 119 winds the base sheet 114 of the label sheet 112. All of the sheet holding shaft 117, the platen 118, and the base-sheet winding shaft 119 project from a sidewall 120 of the print unit 105 and maintain a cantilever state. In the print unit 105, the sheet holding shaft 117 and the base-sheet winding shaft 119 form a guide path 122 for the label sheet 112 leading from the sheet holding shaft 117 to the base-sheet winding shaft 119.

The print unit 105 includes a peeling unit 121. The peeling unit 121 is arranged near a downstream side of the platen 118 in the guide path 122. The peeling unit 121 bends only the base sheet 114 of the label sheet 112 at an acute angle in a direction for separating the base sheet 114 from the labels 113. The peeling unit 121 peels printed labels 113 from the base sheet 114 and issues the printed labels 113 from the issue port 106. The base-sheet winding shaft 119 winds the base sheet 114.

Figure 3A:
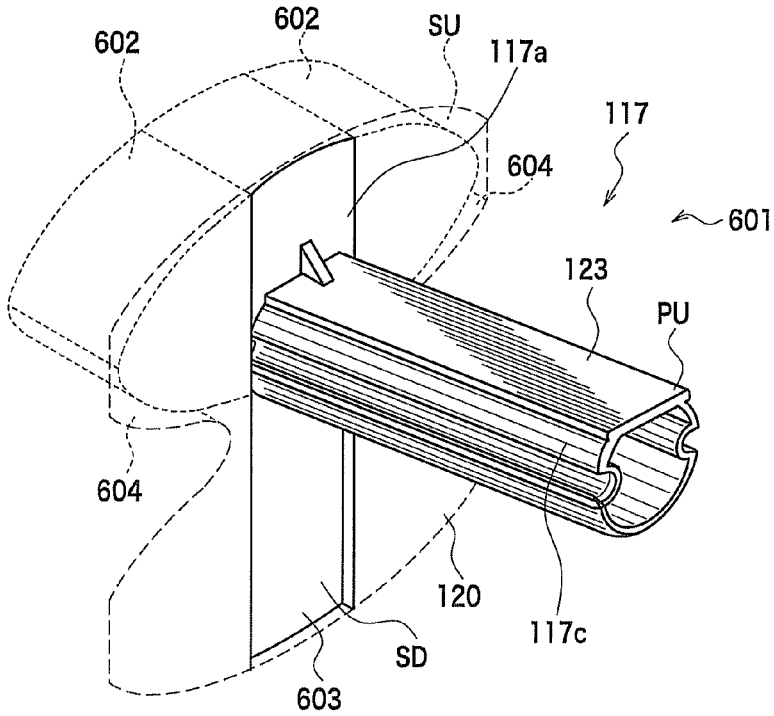
FIGS. 3A and 3B are perspective views of a sheet holding shaft and a slide holding mechanism.
Figure 3B:
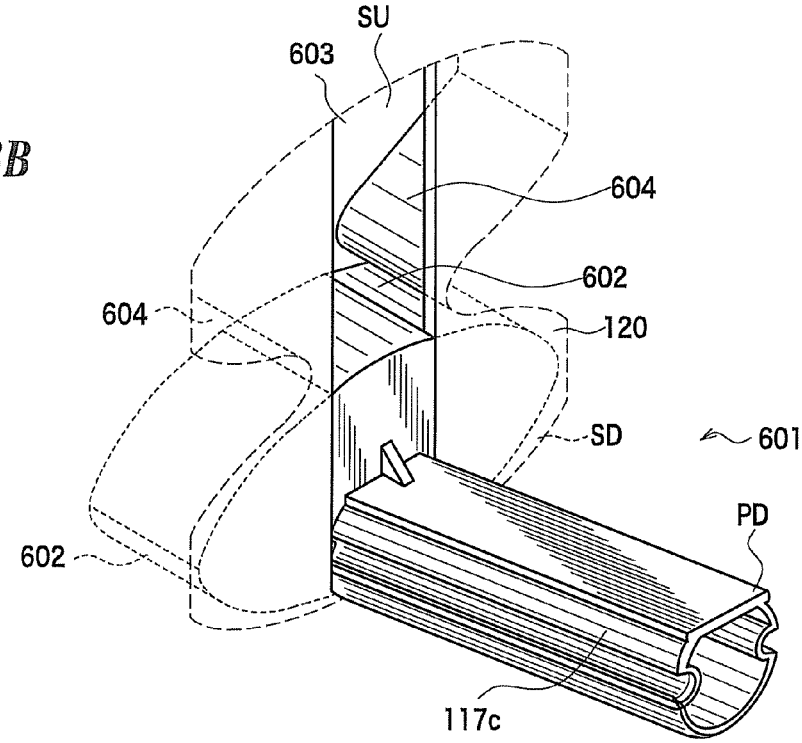

FIGS. 3A and 3B are perspective views of the sheet holding shaft 117 and a slide holding mechanism 601. The sidewall 120 has a slender regulation hole 603 opened vertically. The sheet holding shaft 117 has, on a top surface thereof, a pipe-like elongated section 117*c* having a flat surface 123 extending over the entire length in an axis direction and a flat section for attachment 117*a* fixed to a base of the elongated section 117*c*. In the sheet holding shaft 117, the flat section for attachment 117*a* is arranged on the rear side of the sidewall 120 and the elongated section 117*c* is arranged on the front side of the sidewall 120 through the regulation hole 603. A pair of leaf springs 602 are fixed to the flat section for attachment 117*a*.

The leaf springs 602 have a wing shape symmetrically projecting in the left and right directions from both the ends of the flat section for attachment 117*a*. The leaf springs 602 are also located on the rear side of the sidewall 120 together with the flat section for attachment 117*a*.

A pair of leaf spring stoppers 604 are provided on the rear side of the sidewall 120. The leaf spring stoppers 604 project in directions opposite to the projecting directions of the leaf springs 602 at the height substantially in the center of the regulation hole 603 and are symmetrically arranged to be opposed to each other. Therefore, an opposed space between the pair of leaf spring stoppers 604 is widened in upper and lower positions of the regulation hole 603 and is gradually narrowed toward the center of the regulation hole 603. The pair of leaf springs 602 fixed to the flat section for attachment 117*a* of the sheet holding shaft 117 are selectively located in a space SU above the leaf spring stoppers 604 and a space SD below the leaf spring stoppers 604. The leaf spring stoppers 604 bend when the elongated section 117*c* passes the center of the regulation hole 603. When the leaf springs 602 are located in the space SU above the leaf spring stoppers 604, the leaf springs 602 are prevented from falling down by the leaf spring stoppers 604. A position where the sheet holding shaft 117 stands still at this point is an upper position PU (FIG. 3A).

When the operator applies downward force to the sheet holding shaft 117 located in the upper position PU, the leaf springs 602 bend to be deformed when the elongated section 117*c* passes the center of the regulation hole 603 and allow the elongated section 117*c* to move. When the deformed leaf springs 602 are located in the space SD below the leaf spring stopper 604, the leaf springs 602 are restored to the original shape by the elasticity thereof. A position where the sheet holding shaft 117 stands still at this point is a lower position PD (FIG. 3B). Therefore, the leaf springs 602, the regulation hole 603, and the leaf spring stoppers 604 configure the slide holding mechanism 601 that slides the sheet holding shaft 117 up and down and holds the sheet holding shaft 117 in one of the upper position PU and the lower position PD. The slide holding mechanism 601 is adopted to maintain a state in which the label sheet 112 (see FIG. 4) having the paper pipe 115 larger in a diameter than the roll-like label sheet 112 shown in FIG. 2 is stored in the printer 101 and held by the sheet holding shaft 117.

The sheet holding shaft 117 is maintained horizontally in the cantilever state by the slide holding mechanism 601. The sheet holding shaft 117 can hold the label sheet 112 in a state in which the paper pipe 115 is inserted over the sheet holding shaft 117. When the label sheet 112 is held, the sidewall 120 functions as a reference plane for positioning a first end face

112*a*, which is one end face of the label sheet 112. The sheet holding shaft 117 functions as a sheet holding unit that rotatably holds the label sheet 112 according to an end face reference by the sidewall 120 functioning as the reference plane.

Referring back to FIG. 2, the label sheet 112 held by the sheet holding shaft 117 with the paper pipe 115 inserted thereover is pushed in the width direction of the label sheet 112 (the axis direction of the sheet holding shaft 117) with a second end face 112*b*, which does not face the sidewall 120 side (the depth side in FIG. 2) but faces the opposite side of the sidewall 120 (the front side in FIG. 2), urged by a rotating member 202 functioning as an interference body. On the other hand, the first end face 112*a* of the label sheet 112 comes into contact with the sidewall 120 functioning as the reference plane. Therefore, the label sheet 112 is sandwiched by the sidewall 120 and the rotating member 202 and regulated from moving in the width direction when the label sheet 112 is drawn out along the guide path 122. The rotating member 202 is an L-shaped flat member as a part of the roll paper holding mechanism 201. The rotating member 202 is rotatably attached to the distal end of an arm main section 203, which forms a part of the roll paper holding mechanism 201, via a rotating-member rotating shaft 207. The arm main section 203 rotates and interferes with the second end face 112*b* of the label sheet 112, whereby the rotating member 202 is rotationally displaced. The rotating member 202 can be removed from the arm main section 203, vertically reversed, and attached to the arm main body 203. Details of the structure of the roll paper holding mechanism 201 including the rotating member 202 and the arm main section 203 are explained later with reference to FIGS. 6 to 9.

The platen 118 is located below the guide path 122. The platen 118 receives driving force from a platen motor (not shown in the figure) via a gear train (not shown in the figure) to rotate, applies conveying force to the label sheet 112 on the guide path 122, and draws out the label sheet 112 held by the sheet holding shaft 117 along the guide path 122. The platen 118, the platen motor, and the gear train function as a conveying unit that draws out the label sheet 112 and conveys the label sheet 112 along the guide path 122.

The base-sheet winding shaft 119 receives driving force from a winding motor (not shown in the figure) housed in a motor housing 132 (see FIG. 6) via a gear train (not shown in the figure) arrayed on the rear surface side of the sidewall 120 to rotate and winds only the base sheet 114 of the label sheet 112 that finishes passing through the peeling unit 121. The peeling unit 121 and the base-sheet winding shaft 119 are respectively located in positions where the base-sheet winding shaft 119 winds the base sheet 114 and bends the base sheet 114 at an acute angle in the section of the peeling unit 121.

Figure 4:
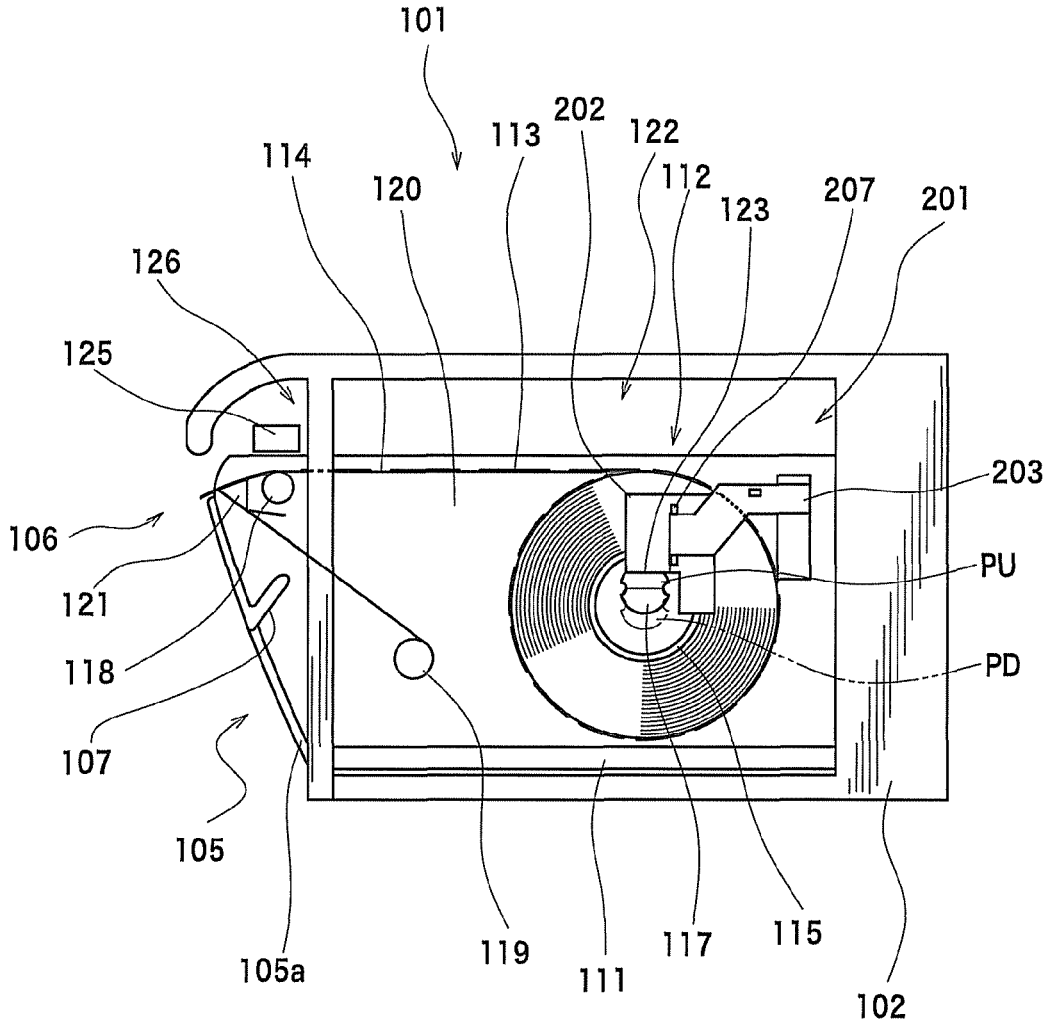
FIG. 4 is a schematic longitudinal sectional side view of the printer in a state in which the sheet holding shaft is located in an upper position.

FIG. 4 is a schematic longitudinal sectional side view of the printer 101 in a state in which the sheet holding shaft 117 is located in the upper position. As explained above with reference to FIGS. 3A and 3B, the print unit 105 according to this embodiment can selectively locate the sheet holding shaft 117 in the lower position PD (indicated by a dotted line in FIG. 4; see FIG. 2 as well) or the upper position PU (indicated by a solid line in FIG. 4). If a direction for attaching the rotating member 202 of the roll paper holding mechanism 201 to the arm main section 203 is changed, regardless of whether the sheet holding shaft 117 is located in the lower position PD or the higher position PU as shown in FIGS. 2 and 4, the rotating member 202 can come into contact with not only the second end face 112*b* of the label sheet 112 inserted over the sheet holding shaft 117 but also the end face of the paper pipe 115 of the label sheet 112. This point is explained later with reference to FIG. 7.

Figure 5:
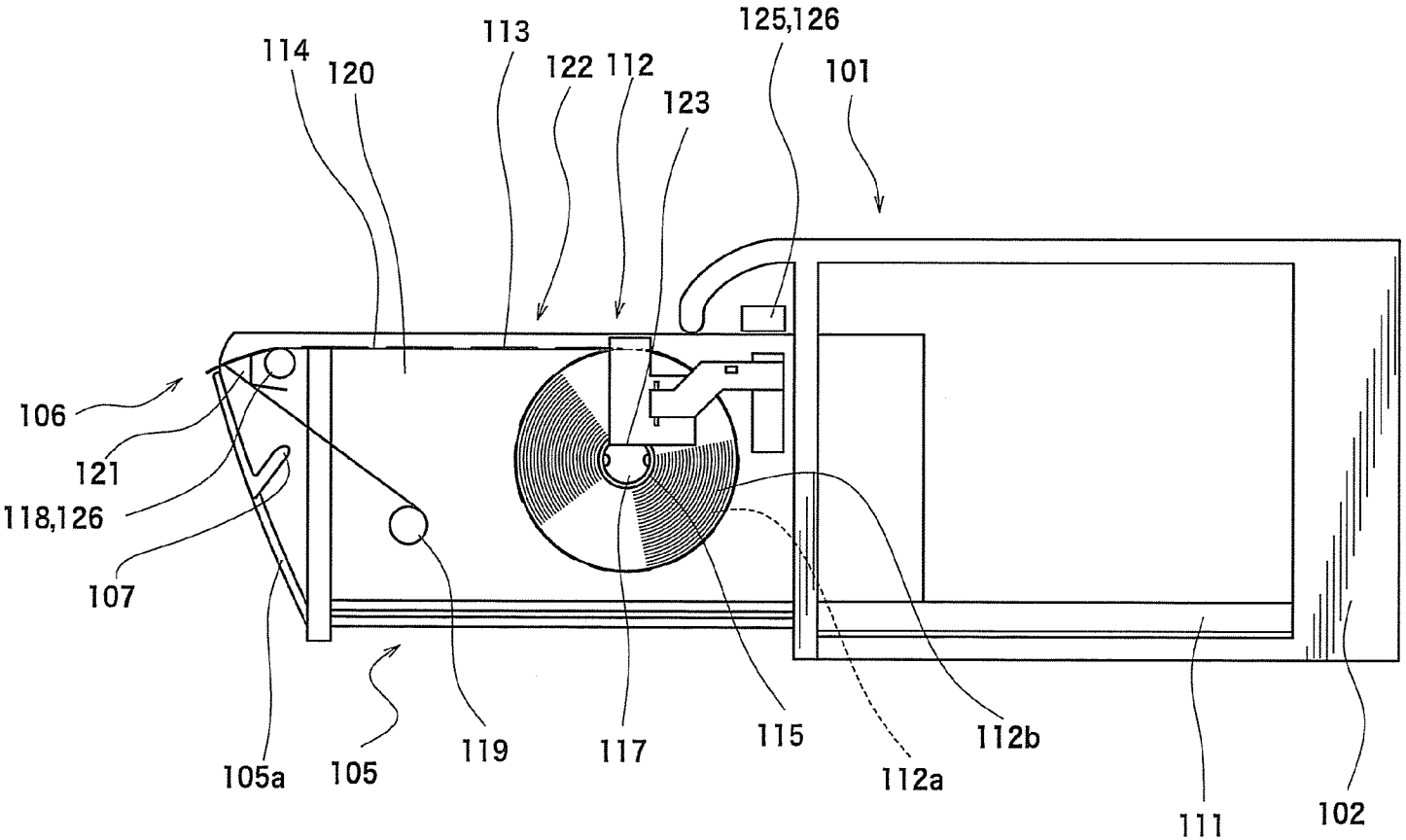
FIG. 5 is a schematic longitudinal sectional side view of the printer in a state in which the print unit is drawn out from the housing.

FIG. 5 is a schematic longitudinal sectional side view of the printer 101 in a state in which the print unit 105 is drawn out from the housing 102. A pair of rails 111 are provided in a lower part on the inner side of the housing 102. The rails 111 extend horizontally from an opening provided on the front side of the housing 102 to the depth side and slidably support the print unit 105. Therefore, the operator can slide the print unit 105 in the front direction along the rails 111 by drawing out the print unit 105 gripping the grip 107 and change a state in which the print unit 105 is housed in the housing 102 (see FIG. 2) to a state in which the print unit 105 is drawn out to the outside of the housing 102 (FIG. 5). The operator can also slide the print unit 105 along the rails 111 in the depth direction gripping the grip 107 and change the state in which the print unit 105 is drawn out (FIG. 5) to the state in which the print unit 105 is housed (see FIG. 2).

A thermal head 125 is arranged in an upper part in the inside of the housing 102. The thermal head 125 is a line-type thermal print head. The thermal head 125 is opposed to the platen 118 in a state in which the print unit 105 is housed in the housing 102. The thermal head 125 and the platen 118 configure a printing unit 126.

Figure 6:
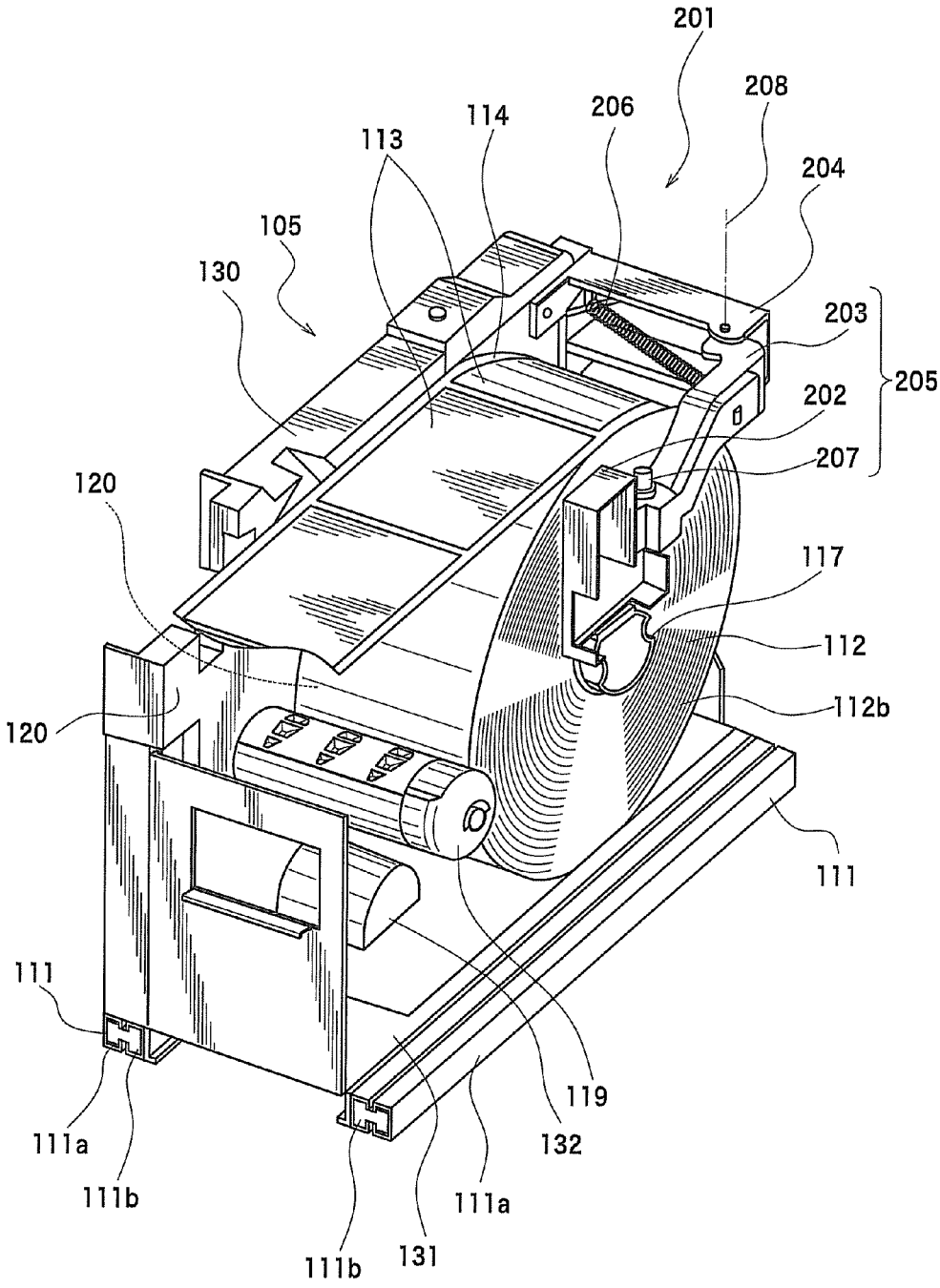
FIG. 6 is a perspective view of the print unit in a state in which a label sheet is inserted over the sheet holding shaft.

FIG. 6 is a perspective view of the print unit 105 in a state in which the label sheet 112 is inserted over the sheet holding shaft 117. In FIG. 6, the front panel 105*a*, the platen 118, and the peeling unit 121 are not shown. Main components of a frame of the print unit 105 are a side frame 130 having the sidewall 120 and a bottom frame 131 forming the bottom. In the bottom frame 131, the side frame 130 is fixed to one side. Therefore, the print unit 105 is formed in a substantially L-shape viewed from the front side. The sidewall 120 of the side frame 130 supports the sheet holding shaft 117 and the base-sheet winding shaft 119 in a cantilever state in parallel to the bottom frame 131. The bottom frame 131 is attached with the motor housing 132 that houses the winding motor (not shown in the figure).

Both the sides of the bottom frame 131 are slidable to the housing 102 via the rails 111. The rails 111 have a pair of elongated fixed rails 111*a* formed in a C shape in section and a pair of elongated moving rails 111*b* that fit in the inner side of the C shape of the fixed rails 111*a*. The pair of fixed rails 111*a* are respectively fixed to both the sides in the inside of the housing 102 in a direction extending from the front side to the depth side of the housing 102. The pair of moving rails 111*b* are respectively fixed to both side sections of the bottom frame 131 of the print unit 105. The housing 102 slidably houses the print unit 105 because the moving rails 111*b* fit in the fixed rails 111*a*.

The roll paper holding mechanism 201 is explained. The roll paper holding mechanism 201 includes a first arm 204, a second arm 205, and a spring 206 as an urging unit. The roll paper holding mechanism 201 presses the second end face 112*b* of the label sheet 112 held by the sheet holding shaft 117. The second arm 205 includes the rotating member 202 and the arm main section 203 rotatably coupled via the rotating-member rotating shaft 207. The second arm 205 is a contact body that is rotationally displaced with a vertical shaft 208 as a rotation center and comes into contact with the second end face 112*b* of the label sheet 112 on a free end side thereof.

The first arm 204 is fixed to an upper end position on the right of the side frame 130 and projects from the sidewall 120 in the same direction as the sheet holding shaft 117 and the base-sheet winding shaft 119. The first arm 204 is formed in a C shape in section and rotatably supports the arm main section 203 with an upper piece and a lower piece. Consequently, the arm main section 203 rotates around the vertical shaft 208 to bring a section on the free end side not supported by the first arm 204 close to and separate the section from the second end face 112*b* of the label sheet 112 held by the sheet holding shaft 117.

The arm main section 203 rotatably supports the rotating member 202 around the vertical shaft 208 at the distal end of the free end side. The rotating-member rotating shaft 207 functioning as an attachment structure 207*a* for attaching the rotating member 202 to the arm main section 203 couples the arm main section 203 and the rotating member 202. The rotating member 202 is a substantially L-shaped flat member and has a contact surface 209 (see FIG. 7) that comes into contact with the second end face 112*b* of the label sheet 112.

The spring 206 connects the first arm 204 and the arm main section 203. One end of the spring 206 is hooked to a section at the base of the first arm 204 attached to the sidewall 120. The other end of the spring 206 is hooked to a section near the vertical shaft 208 in the arm main section 203. The spring 206 urges the second arm 205 (the rotating member 202 and the arm main section 203) in a direction approaching the sidewall 120 (a first rotating direction) and pulls the second arm 205.

Figure 7:
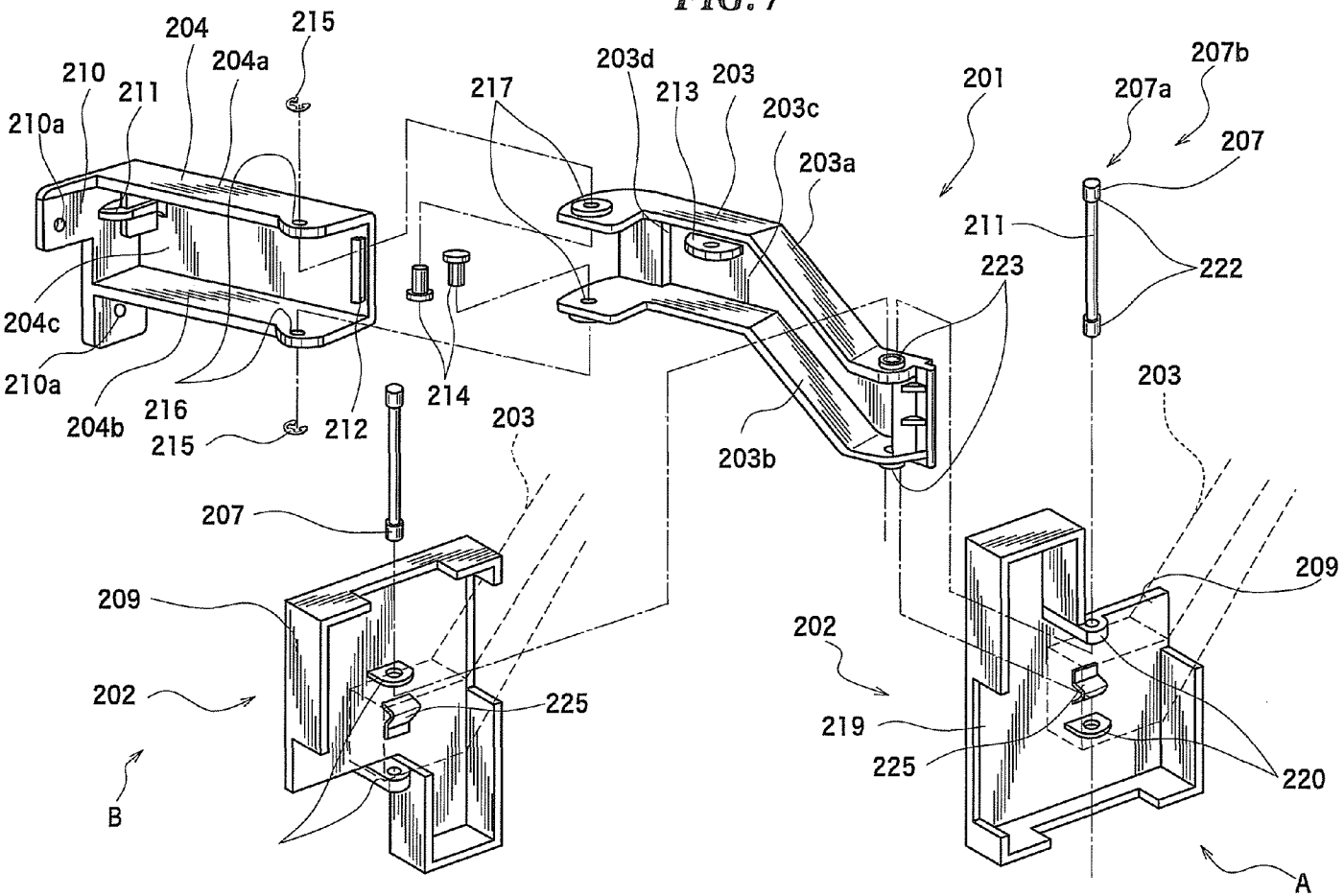
FIG. 7 is a disassembled perspective view of a roll paper holding mechanism.

FIG. 7 is a disassembled perspective view of the roll paper holding mechanism 201. The first arm 204 of the roll paper holding mechanism 201 is an elongated member formed in a C shape in section and has a C-shaped upper piece 204*a*, a C-shaped lower piece 204*b*, and a C-shaped side 204*c* that connects these pieces. The first arm 204 has, at the left end in FIG. 7, a flat-shaped contact section for attachment 210 facing a direction of the C-shaped section. The contact section for attachment 210 has an attaching hole 210*a* for screwing to fix the first arm 204 to the sidewall 120 of the print unit 105. A spring attaching section 211 for attaching one end of the spring 206 is provided between the contact section for attachment 210 and the C-shaped side 204*c*. A stopper 212 projects at the right end in FIG. 7 of the C-shaped side 204*c*.

The arm main section 203 of the roll paper holding mechanism 201 has an elongated C-shape in section inscribable with the first arm 204. The arm main section 203 is a member formed in a shape, a right half portion of which in FIG. 7 shifts downward, and has a C-shaped upper piece 203*a*, a C-shaped lower piece 203*b*, and a C-shaped side 203*c* that connects these pieces. The C-shaped side 203*c* has, in the left side portion thereof in FIG. 7, a spring attaching section 213 for attaching the other end of the spring 206. A step 203*d* (see FIGS. 8 and 9 as well) that comes into contact with the stopper 212 is formed on the outer side of the C shape of the C-shaped side 203*c*.

The arm main section 203 is rotatably coupled to the first arm 204 by headed shafts 214, in shaft sections of which cut grooves are formed, and E rings 215 that fit in the cut grooves. Specifically, in the first arm 204, shaft holes 216 are formed in positions opposed to both the C-shaped upper piece 204*a* and the C-shaped lower piece 204*b* at the right end in FIG. 7. In the arm main section 203, shaft holes 217 are formed in positions opposed to both the C-shaped upper piece 203*a* and the C-shaped lower piece 203*b* at the left end in FIG. 7. The arm main section 203 is inscribed with the inner side of the first arm 204 and rotatably coupled to the first arm 204 by fitting the shaft sections of the headed shafts 214 in the shaft holes 216 and 217 from the inner side in a state in which the shaft holes 216 and 217 are aligned, and pressing the E rings 215 in the projecting shaft sections of the shafts 214.

The arm main section 203 rotatably supports the rotating member 202 at the end on the opposite side of the end connected to the first arm 204. The structure of the rotating member 202 is explained on the basis of the rotating member 202 indicated by a reference sign A on the lower right of FIG. 7. The rotating member 202 is a substantially L-shaped flat member and mainly includes a substantially L-shaped flat plate 219 having the contact surface 209. The flat plate 219 has, on a surface on the opposite side of the contact surface 209, two attaching sections 220 for attaching the rotating-member rotating shaft 207. On the surface on the opposite side, a pawl section 225 is prepared between the two attaching sections 220. The rotating-member rotating shaft 207 attached to the attaching sections 220 of the rotating member 202 has slip-off preventing sections 222 thicker than a thin shaft 221 at both the ends of the shaft 221. The attaching sections 220 have holes having size same as that of the slip-off preventing sections 222 of the rotating-member rotating shaft 207. The rotating-member rotating shaft 207 can be inserted from the holes. The inserted rotating-member rotating shaft 207 is urged by the pawl section 225 and pressed in a direction separating from the flat plate 219 to be prevented from falling off from the attaching sections 220.

The rotating member 202 is rotatably coupled to the arm main section 203 by the rotating-member rotating shaft 207. The arm main section 203 has, in positions opposed to both of the C-shaped upper piece 203*a* and the C-shaped lower piece 203*b* at the right end in FIG. 7, rotating shaft holes 223 in which the rotating-member rotating shaft 207 is inserted. As indicated by a dotted line in the rotating member 202 denoted by the reference sign A in FIG. 7, the arm main section 203 and the rotating member 202 can be rotatably coupled by locating the rotating shaft holes 223 of the arm main section 203 to be set in contact with the inner side of the attaching sections 220 of the rotating member 202 and aligning the rotating shaft holes 223 and the holes of the attaching sections 220, and inserting the rotating-member rotating shaft 207 through the holes from above. The rotating shaft for rotating member 207, the attaching sections 220, and the rotating shaft holes 223 configure the attachment structure 207*a*.

The rotating member 202 is rotatably coupled to the arm main section 203 even in a state in which the rotating member 202 is set in the direction of the rotating member 202 shown on the lower left in FIG. 7 (the direction of the rotating member 202 indicated by a reference sign B; a first posture) by rotating 180 degrees to vertically reverse the rotating member 202 from the direction of the rotating member 202 shown on the lower right in FIG. 7 (the direction of the rotating member 202 indicated by the reference sign A; a second posture). In this case, as indicated by a dotted line in the rotating member 202 denoted by the reference sign B in FIG. 7, the rotating member 202 is rotatably coupled to the arm main section 203 by locating the rotating shaft holes 223 of the arm main section 203 to be set in contact with the inner side of the attaching sections 220 of the rotating member 202, aligning the rotating shaft holes 223 and the holes of the attaching sections 220, and inserting the rotating-member rotating shaft 207 through the holes.

When the rotating member 202 is attached to the arm main section 203 in the first posture, the bottom side of the rotating member 202 is located at the height of the flat surface 123 of the sheet holding shaft 117 located in the lower position PD. When the rotating member 202 is attached to the arm main section 203 in the second posture, a lower side L of a portion protruding to the left of the rotating member 202 denoted by the reference sign B in FIG. 7 is located at the height of the flat surface 123 of the sheet holding shaft 117 located in the upper position PU. In other words, regardless of whether the sheet holding shaft 117 is located in the upper position PU or the lower position PD by attaching the rotating member 202 to the arm main section 203 with the direction of the rotating member 202 changed, it is possible to press, with the rotating member 202, the end face of the paper pipe 115 of the roll paper 30 held by the sheet holding shaft 117. Therefore, the attachment structure 207*a* also plays a role of a posture displacing mechanism 207*b* that causes the rotating member 202 to take the first posture or the second posture.

Figure 8:
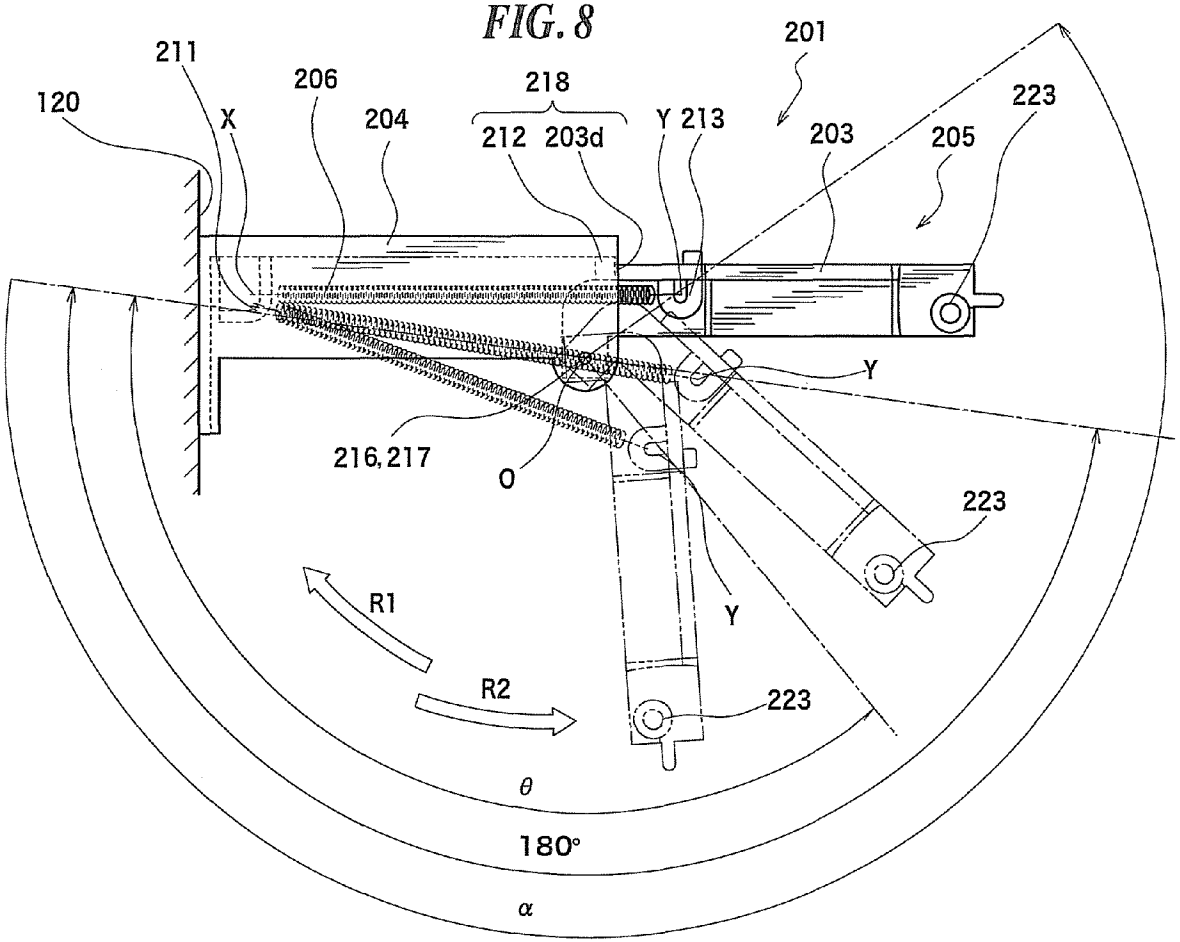
FIG. 8 is a schematic plan view of the roll paper holding mechanism in which an attachment position of a spring is shown.

FIG. 8 is a schematic plan view of the roll paper holding mechanism 201 in which an attachment position of the spring 206 is shown. In FIG. 8, the rotating member 202 included in the second arm 205 is not shown. Both the ends of the spring 206 connects the spring attaching section 211 provided in the first arm 204 and the spring attaching section 213 provided in the arm main section 203. An angle formed by a half line OX extending from the shaft hole 216 (a point O) to the spring attaching section 211 (a point X) in the arm 204 and a half line OY extending from the shaft hole 217 (the point O) to the spring attaching section 213 (a point Y) in the arm main section 203 is represented as θ.

When the first arm 204 and the arm main section 203 have a positional relation θ<180° (the position of the aim main section 203 at this point is indicated by an alternate long and two short dashes line in FIG. 8), the spring 206 urges and pulls the arm main section 203 to rotationally displace the arm main section 203 in a first rotating direction (indicated by an arrow R1 in FIG. 8) for bringing the contact surface 209 (see FIG. 7) of the rotating member 202 close to the first end face 112*a* of the label sheet 112. When the arm main section 203 is located in a position where θ>180° with respect to the first arm 204, the spring 206 urges and pulls the arm main section 203 to rotationally displace the arm main section 203 in a second rotating direction (indicated by an arrow R2 in FIG. 8) for separating the contact surface 209 of the rotating member 202 from the second end face 112*b* (see FIG. 5) of the label sheet 112. In FIG. 6, the position of the arm main section 203 in the case of θ=180° is indicated by an alternate long and short dash line.

When the arm main section 203 is located in the position where θ=predetermined angle α (α>180° in the process of being rotationally displaced in the second rotating direction R2 (the position of the arm main section 203 at this point is indicated by a solid line in FIG. 8), the step 203*d* formed in the C-shaped side 203*c* bumps against the stopper 212 provided in the first arm 204 and stops in this position where θ=predetermined angle α. In other words, the stopper 212 and the step 203*d* configure a holding mechanism 218 that holds the arm main section 203 in the position where θ=predetermined angle α.

Figure 9:
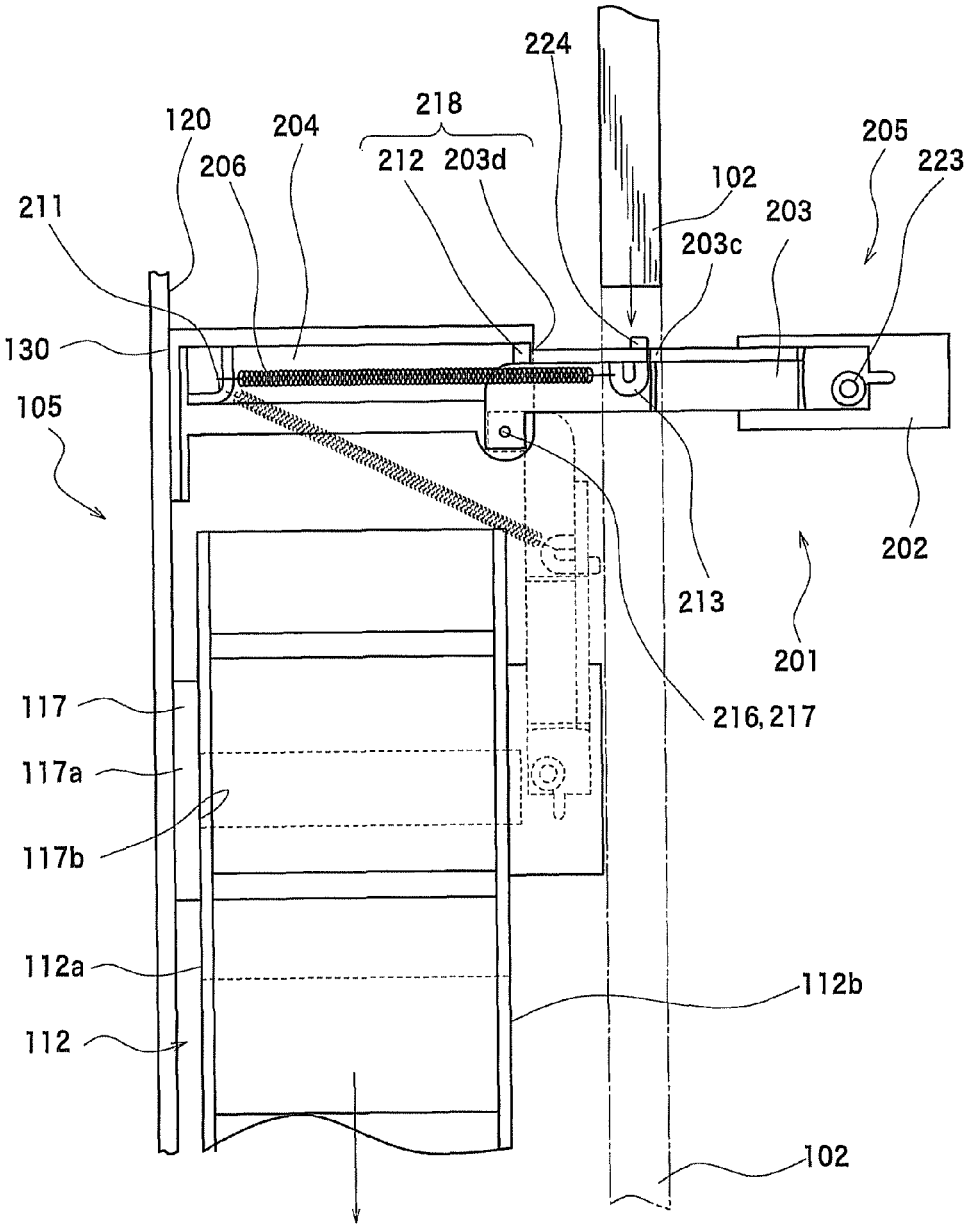
FIG. 9 is a schematic plan view of the printer in which a positional relation between the housing and the roll paper holding mechanism is shown.

FIG. 9 is a schematic plan view of the printer 101 in which a positional relation between the housing 102 and the roll paper holding mechanism 201 is shown. As explained above, the housing 102 supports the print unit 105 to be freely drawn out. In FIG. 9, the print unit 105 is mainly shown. The housing 102 in which the print unit 105 is housed is indicated by an alternate long and short dash line. The housing 102 from which the print unit 105 is drawn out is indicated by a thick solid line.

Points explained below are important concerning an attachment position in the horizontal direction in attaching the roll paper holding mechanism 201 to the housing 102. As shown in FIG. 9, in a state in which the rotating member 202 is in contact with the second end face 112*b* of the label sheet 112, the second arm 205 presses the second end face 112*b* of the label sheet 112 without interfering with the housing 102 when the print unit 105 is drawn out or housed. In a state in which the arm main section 203 is held by the holding mechanism 218, the first arm 204 of the roll paper holding mechanism 201 is attached to the sidewall 120 of the side frame 130 such that the arm main section 203 is located across a passing space of the housing 102 and the rotating member 202 projects further to the right than the housing 102. In the state in which the arm main section 203 is held by the holding mechanism 218, when the print unit 105 slides and is housed in the housing 102, in a process of the sliding, the arm main section 203 interferes with the housing 102 and is rotationally displaced in the first rotating direction R1. In the C-shaped side 203*c* of the arm main section 203, a projection 224 is provided in a position interfered by the housing 102. Even if the arm main section 203 collides with the housing 102 in a process of housing the print unit 105, the arm main section 203 is prevented from being damaged.

Points explained below are important concerning a height position in attaching the roll paper holding mechanism 201 to the housing 102. As shown in FIGS. 2 and 4, regardless of whether the sheet holding shaft 117 is located in the lower position PD or the upper position PU, the first arm 204 is attached to the sidewall 120 of the side frame 130 of the print unit 105 in a height position where the contact surface 209 of the rotating member 202 comes into contact with not only the second end face 112*b* of the label sheet 112 inserted over the sheet holding shaft 117 but also the end face of the paper pipe 115 of the label sheet 112. As one form, the first arm 204 is attached to the sidewall 120 such that the bottom side of the rotating member 202 and the flat surface 123 of the sheet holding shaft 117 are located in the same height position. As explained above with reference to FIG. 7, making use of the fact that the arm main section 203 can be attached even if the rotating member 202 is rotated 180 degrees, the shape of the rotating member 202 is decided such that a height position of the flat surface 123 that changes according to the attachment position of the sheet holding shaft 117 (the lower position PD or the upper position PU) and a height position of the bottom side of the rotating member 202 that changes according to relocation coincide with each other.

Actions are explained below. In the printer 101 according to this embodiment, when power is supplied from a commercial power supply, a microcomputer (not shown in the figure) incorporated in the housing 102 controls to drive the units of the printer 101 and executes print processing. When the print processing is performed, in the printer 101, the label sheet 112 held by the sheet holding shaft 117 with the paper pipe 115 inserted over the sheet holding shaft 117 is conveyed along the guide path 122 according to the rotation of the platen 118. Printing based on print data is applied to the label sheet 112 by the thermal head 125. The print data includes, for example, measurement data of an article, which is placed on the measuring plate 110, output by the main body apparatus 109 of the measuring apparatus 108. In this way, simultaneously with the print processing, the microcomputer also performs processing for controlling to drive a winding motor (not shown in the figure) to rotate the base-sheet winding shaft 119 and winding the base sheet 114 forming a part of the label sheet 112. The printed label 113 is peeled off from the base sheet 114 by the peeling unit 121 and issued from the issue port 106.

When the control driving for the units is performed, the label sheet 112 inserted over the sheet holding shaft 117 is not only pulled by the platen 118 and rotates in a direction around the sheet holding shaft 117 but also moves in the axis direction of the sheet holding shaft 117 (the width direction of the label sheet 112). The second end face 112*b* of the label sheet 112 comes into contact with the contact surface 209 of the rotating member 202 included in the roll paper holding mechanism 201. The rotating member 202 receives urging force in a direction from the spring 206 to the sidewall 120 and is urged in the direction of the sidewall 120 of the side frame 130. Therefore, the label sheet 112 is urged by the rotating member 202 and the first end face 112*a* of the label sheet 112 comes into contact with the sidewall 120 functioning as a reference plane. The label sheet 112 is held between the sidewall 120 and the rotating member 202 and stops moving in the width direction. Regardless of whether the sheet holding shaft 117 is located in the upper position PU or the lower position PD, the label sheet 112 receives the urging force with not only the second end face 112*b* of the label sheet 112 but also the end face of the paper pipe 115 brought into contact with the contact surface 209 of the rotating member 202. Therefore, even in a state in which the label sheet 112 printed by the printer 101 is about to be exhausted, the movement in the width direction of the label sheet 112 is regulated. Further, the rotating member 202 can be rotated 180 degrees and attached to the arm main section 203 as shown in FIG. 7. Even when the attachment position of the sheet holding shaft 117 is changed according to a standard of the label sheet 112, the movement in the width direction of the label sheet 112 can be surely regulated by inserting the label sheet 112 over the sheet holding shaft 117 with the direction of the rotating member 202 changed to correspond to the flat surface 123 of the sheet holding shaft 117 located in the attachment position. In addition, the rotating member 202 rotates in the direction around the rotating-member rotating shaft 207 directed in the vertical direction. Therefore, regardless of the size of the sheet width of the label sheet 112 inserted over the sheet holding shaft 117, it is possible to two-dimensionally fit the contact surface 209 of the rotating member 202 to the second end face 112*b* of the label sheet 112 and surely regulate the movement in the width direction of the label sheet 112.

In the roll paper holding mechanism 201 according to this embodiment, the arm main section 203 can be held in an open state by the holding mechanism 218 (the stopper 212 of the first arm 204 and the step 203*d* of the arm main section 203). Therefore, the operator can readily perform work for inserting the label sheet 112 over the sheet holding shaft 117 without holding the arm main section 203 by hand in a state in which the print unit 105 is drawn out from the housing 102.

When the operator slides the print unit 105 in the direction for housing the print unit 105 in the housing 102 while keeping the arm main section 203 held by the holding mechanism 218, the housing 102 bumps against the projection 224 provided in the arm main section 203. The arm main section 203 is rotationally displaced in the first rotating direction R1 and pulled by the spring 206. As a result, the rotating member 202 attached to the distal end of the arm main section 203 comes into contact with the second end face 112*b* of the label sheet 112. In this way, in the printer 101 according to this embodiment, when the operator inserts the label sheet 112, even if the operator fails to close the arm main section 203 and houses the print unit 105 in the housing 102 with the arm main section 203 opened, the rotating member 202 comes into contact with and presses the second end face 112*b* of the label sheet 112. Therefore, it is possible to regulate the movement in the width direction of the label sheet 112.

As explained above, in the printer 101 according to this embodiment, the regulation of the movement in the width direction of the label sheet 112 can be realized simply by, for example, screwing to secure the roll paper holding mechanism 201, which includes only simple structures such as the spring 206 and the first arm 204, to the print unit 105. Therefore, it is possible to realize prevention of a skew of roll paper with a simple structure.

Force applied to the second end face 112*b* of the label sheet 112 by the rotating member 202 is examined. In this embodiment, a connection point X of the spring 206 and the first arm 204 (a predetermined point X) and a contact point Y of the spring 206 and the second arm 205 are set in positions where the spring 206 urges the second arm 205 such that the rotating member 202 presses the second end face 112*b* of the roll paper 30 with fixed pressing force. Since the printing 206 is attached in such positions, even if roll papers 30 having various sheet widths are inserted over the sheet holding shaft 117 as the sheet holding unit, the second end faces 112*b* of the roll papers 30 can be pressed with fixed force. It is possible to make it easy to use the printer 101 and the roll paper holding mechanism 201. An example of a method of calculating the connection point X (the predetermined point X) and the connection point Y for configuring the roll paper holding mechanism 201 in this way is explained below.

Figure 10A:
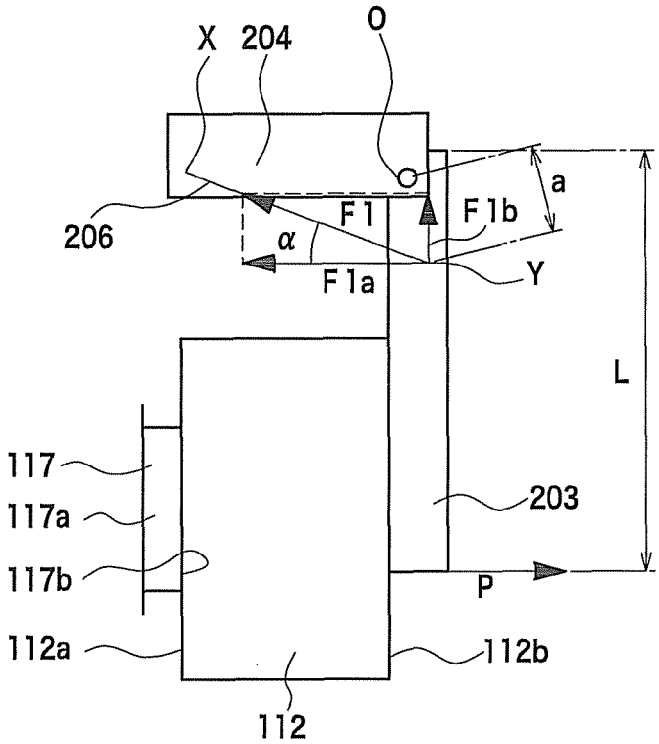
FIGS. 10A and 10B are diagrams for explaining an example of a method of calculating positions of a connection point X (a predetermined point X) and a connection point Y.
Figure 10B:
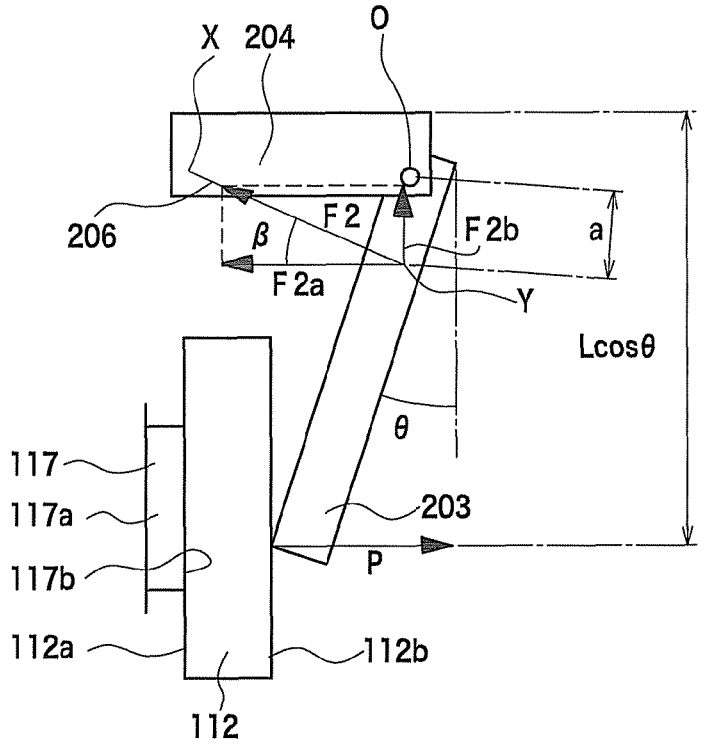

FIGS. 10A and 10B are diagrams for explaining the example of the method of calculating the connection point X (the predetermined point X) and the connection point Y. In FIGS. 10A and 10B, the contact surface 209 is not shown. In the following explanation, as variables, those shown in FIGS. 10A and 10B are used.

In FIG. 10A, a state in which the second end face 112*b* of the label sheet 112 having large label width is pushed with urging force P from the arm main section 203 by elastic force of the spring 206 is shown. This state is hereinafter referred to as "large label width". In FIG. 10B, a state in which the label sheet 112 is changed to a label sheet having small label width from the state shown in FIG. 10A. This state is hereinafter referred to as "small label width". First, a calculation example in the case in which the pressing force applied to the second end face 112*b* of the label sheet 112 from the arm main section 203 is the same in the state of the large label width and the state of the small label width is examined below.

Calculation Example 1

In the state of the large label width (FIG. 10A), according to a relation of moment around a fulcrum O, since $PL-F_{1a}\times a=0$, i.e., $P=(F_{1a}\times a)/L$, and $P_{1a}=F_1\cos\alpha$, $$P=(F_1\cos\alpha\times a)/L \quad (1)$$

On the other hand, in the state of the small label width (FIG. 10B), according to the relation of moment around the fulcrum O, since $PL\cos\theta-F_{2a}\times a=0$, i.e., $P=(F_{2a}\times a)/L\cos\theta$, and $F_{2a}=F_2\cos\beta$, $$P=(F_2\cos\beta\times a)/L\cos\theta \quad (2)$$

When it is desired to push roll paper with the same load even if label width changes, since a value of P is fixed, Formula (1) and formula (2) are simultaneously set up as follows:

$$(F_1\cos\alpha\times a)/L=(F_2\cos\beta\times a)/L\cos\theta$$

When both the sides of the formula are multiplied by L/a, the following formula is obtained:

$$F_1\cos\alpha=F_2\cos\beta/\cos\theta$$

Since $\theta=\alpha-\beta$, when this is substituted in the above formula, the following formula is obtained:

$$F_1\cos\alpha=F_2\cos\beta/\cos(\alpha-\beta) \quad (3)$$

Therefore, the spring 206 in use and an attachment angle of the spring 206 are determined by determining $F_1$, $F_2$, $\alpha$, and $\beta$ such that the relation of Formula (3) holds. By substituting $F_1$, $F_2$, $\alpha$, and $\beta$ in Formula (1) to determine L and a, it is possible to press the roll-like label sheet 112 with the same load even if label width is changed. By adjusting L and a, it is possible to change pressing force for pressing the roll-like label sheet 112 while maintaining a state in which the label sheet 112 is pressed with fixed load even if label width is changed.

Calculation Example 2

On the basis of the calculation example 1, when it is desired to push the roll-like label sheet 112 with pressing force P in the case of the large label width and with a load smaller than P by N kg in the case of the small label width, in the state of the large label width (FIG. 10A), according to a relation of moment around the fulcrum O, since $PL-F_{1a}\times a=0$, i.e., $P=(F_{1a}\times a)/L$, and $F_{1a}=F_1 \cos \alpha$, $$P=(F_1 \cos \alpha\times a)/L \quad (4)$$

On the other hand, in the state of the small label width (FIG. 10B), according to the relation of moment around the fulcrum O, since $(P-N)L \cos \theta-F_{2a}\times a=0$, i.e., $P=(F_{2a}\times a)/L \cos \theta+N$, and $F_{2a}=F_2 \cos \beta$, $$P=(F_2 \cos \beta\times a)/L \cos \theta+N \quad (5)$$

Since a value of P is fixed, Formula (4) and Formula (5) are simultaneously set up as follows:

$$(F_1 \cos \alpha\times a)/L=(F_2 \cos \beta\times a)/L \cos \theta+N$$

When both the sides of the formula are multiplied by L/a, the following formula is obtained:

$$F_1 \cos \alpha=F_2 \cos \beta/\cos \theta+NL/a$$

Since $\theta=\alpha-\beta$, when this is substituted in the above formula, the following formula is obtained:

$$F_1 \cos \alpha=F_2 \cos \beta/\cos(\alpha-\beta)+NL/a \quad (6)$$

Therefore, the spring 206 in use and an attachment angle of the spring 206 are determined by determining $F_1$, $F_2$, $\alpha$, and $\beta$ such that the relation of Formula (6) holds. By substituting $F_1$, $F_2$, $\alpha$, and $\beta$ in Formula (4) to determine L and a, it is possible to press the roll-like label sheet 112 with the pressing force P in the case of the large label width and with a load smaller than P by N kg in the case of the small label width.

Figure 11:
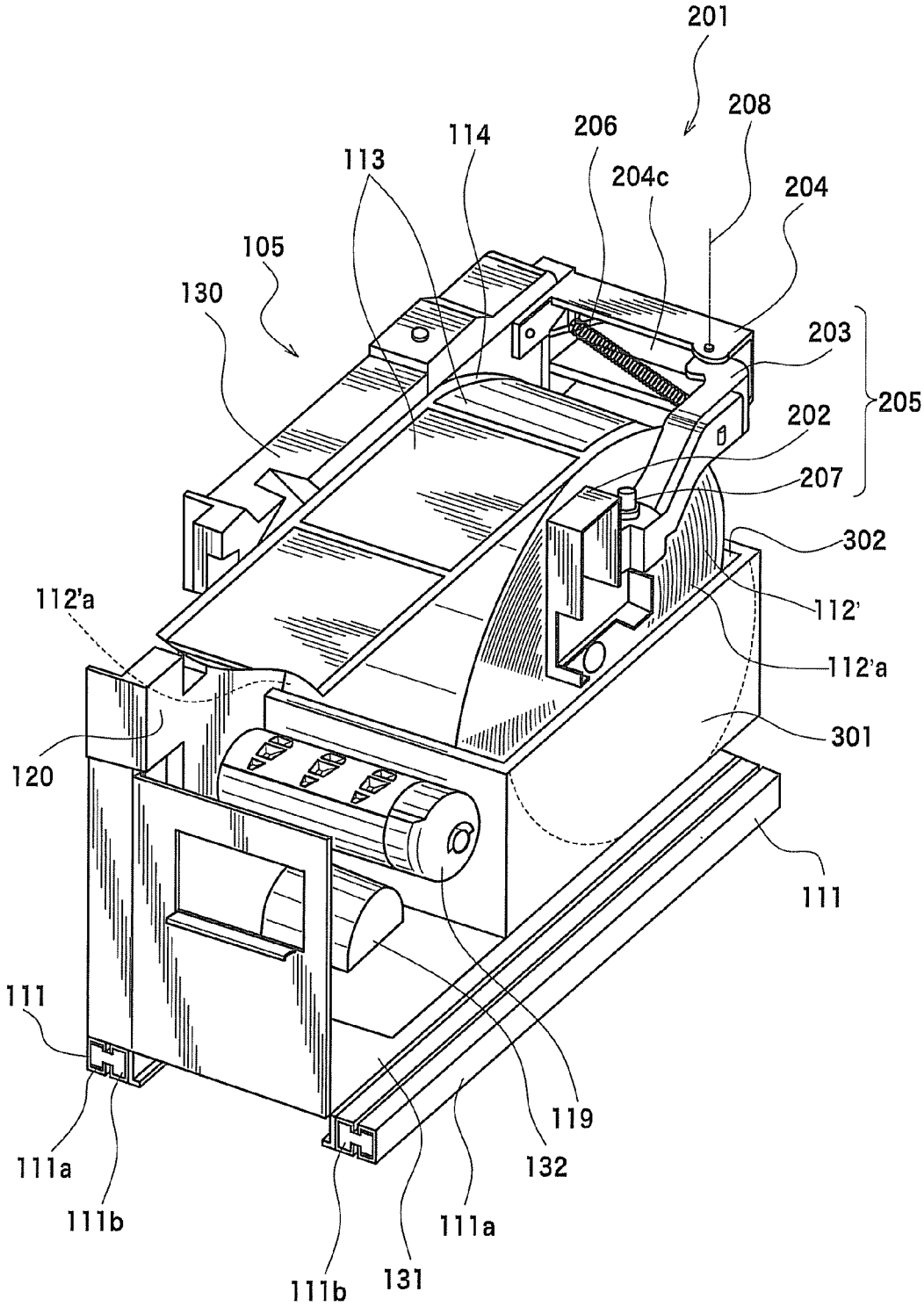
FIG. 11 is a perspective view of a modification of the print unit.

FIG. 11 is a perspective view of a modification of the print unit 105. The modification of the print unit 105 is explained with reference to FIG. 11. The printer 101 according to this modification adopts, in order to store the label sheet 112, a label-sheet storing unit 301 of a throw-in type shown in FIG. 11 as the sheet holding unit instead of the sheet holding shaft 117. The label-sheet storing unit 301 includes a top-open hopper 302 formed in a shape capable of storing therein the label sheet 112 wound in a roll shape. The bottom surface of the hopper 302 is formed in a curved shape such that the stored label sheet 112 can be drawn out along the guide path 122. Such a label-sheet storing unit 301 is attached to the side frame 130 and the bottom frame 131 and can store not only the label sheet 112 (see FIG. 6) having the paper pipe 115 but also a label sheet 112' not having the paper pipe 115. Therefore, in this modification, the contact surface 209 of the rotating member 202 of the roll paper holding mechanism 201 attached to the print unit 105 is brought into contact with a second end face 112'*b* (an end face appearing in FIG. 11) of the label sheet 112' stored in the label-sheet storing unit 301. A first end face 112'*a* of the label sheet 112' (an end face of the label sheet 112' on the opposite side of the second end face 112'*b*) is brought into contact with an inner wall on the sidewall 120 side of the label-sheet storing unit 301. Consequently, the movement in the width direction of the label sheet 112' is regulated and a skew of roll paper is prevented by a simple structure.

Figure 12:
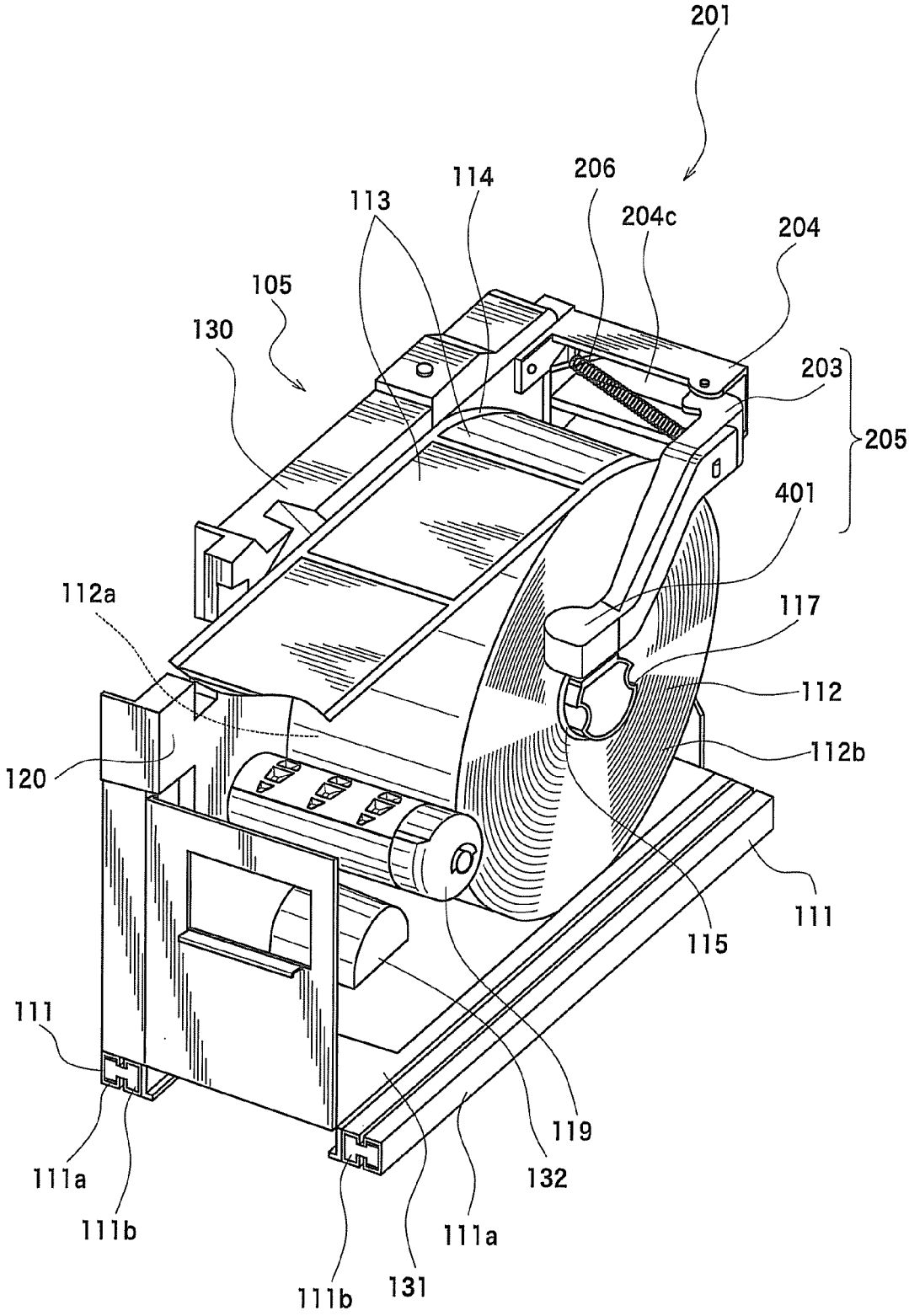
FIG. 12 is a perspective view of a first modification of the roll paper holding mechanism.

FIG. 12 is a perspective view of a first modification of the roll paper holding mechanism 201. The modification of the roll paper holding mechanism 201 is explained with reference to FIG. 12. In this modification, the second arm 205 included in the roll paper holding mechanism 201 does not include the rotating member 202. A distal end section 401 of the arm main section 203 formed as a free end functions as a contact section that comes into contact with the second end face 112*b* of the label sheet 112. A side of the distal end section 401 in contact with the second end face 112*b* of the label sheet 112 is formed as a curved surface with smooth roundness such that the second end face 112*b* can be slid. Therefore, even if label sheets 112 having various sheet widths are inserted over the sheet holding shaft 117, the side of the distal end section 401 comes into contact with the second end faces 112*b* of the label sheets 112 and the distal end section 401 of the arm main section 203 presses the second end faces 112*b* of the label sheets 112 with the urging force of the spring 206. Therefore, since the movement in the width direction of the label sheets 112 is regulated, prevention of a skew of roll paper is realized by a simple structure including a small number of components.

Figure 13:
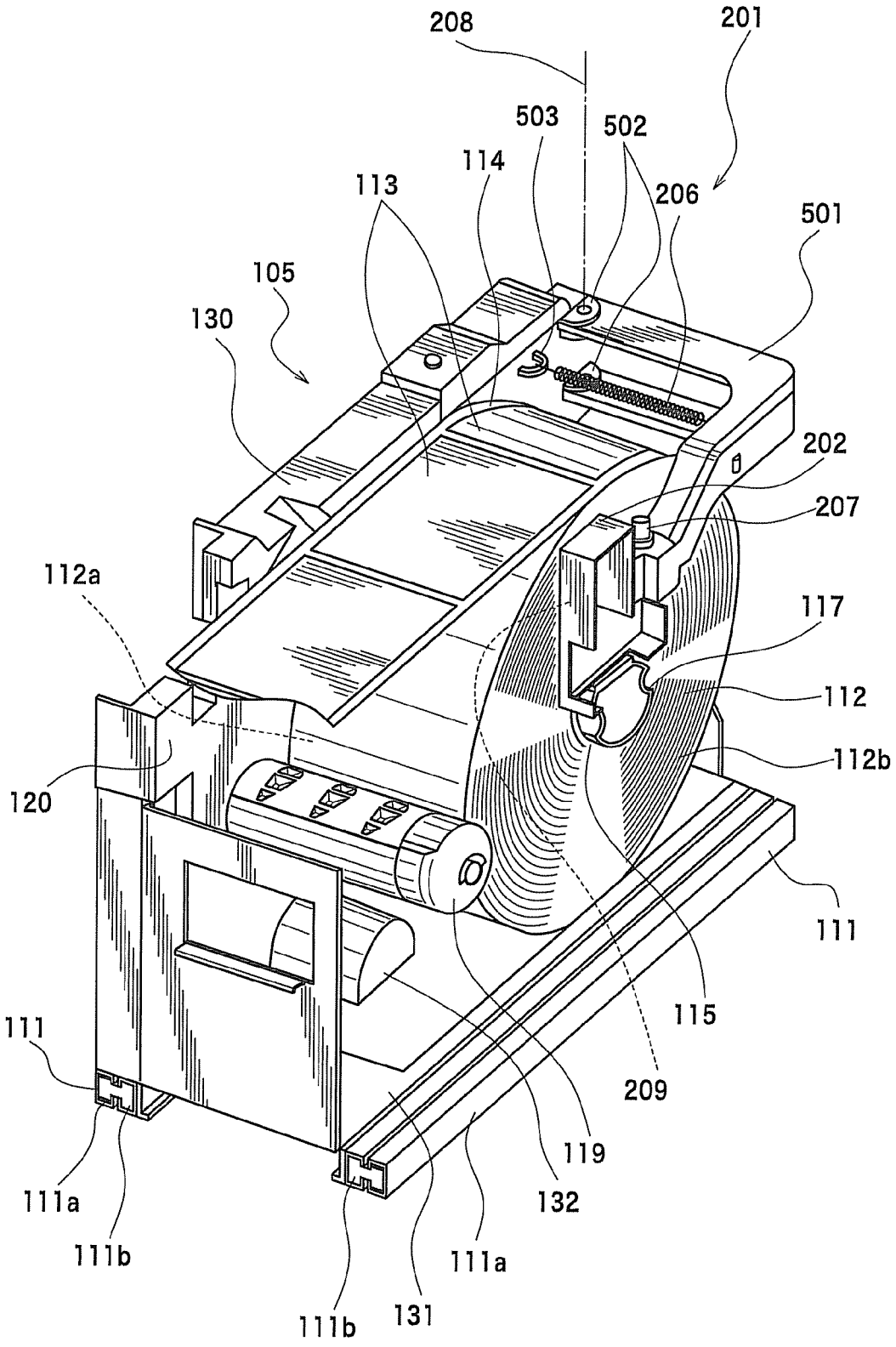
FIG. 13 is a perspective view of a second modification of the roll paper holding mechanism.
Figure 14:
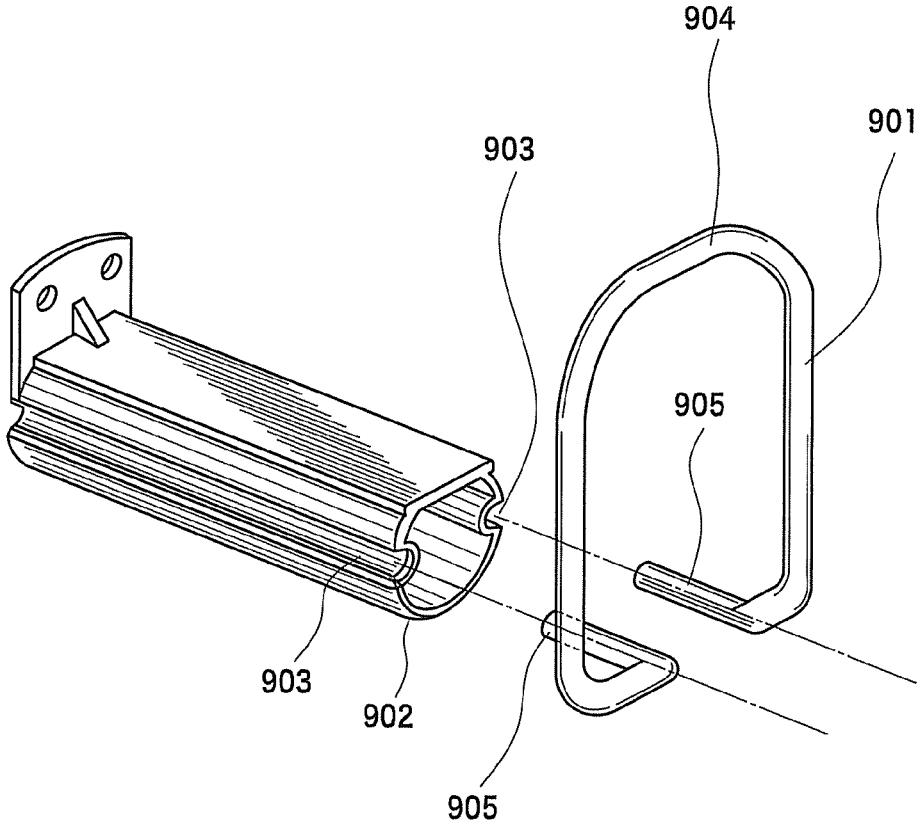
FIG. 14 is a perspective view of a label fastener in an example in the past.

FIG. 13 is a perspective view of a second modification of the roll paper holding mechanism 201. The modification of the roll paper holding mechanism 201 is explained with reference to FIG. 13. In this modification, the roll paper holding mechanism 201 adopts an L-shaped member 501 instead of the first arm 204 and the second arm 205. As shown in FIG. 13, the L-shaped member 501 is rotatably attached to the sidewall 120 of the side frame 130 at one end and has, at the other end, the rotatable rotating member 202 via the rotating-member rotating shaft 207. In this modification, it is necessary to provide an attaching section 502 for rotatably attaching the L-shaped member 501 to the sidewall 120.

In this modification, as shown in FIG. 13, the spring 206 connects a spring attaching section 503 provided on the sidewall 120 and a spring attaching section (not shown in the figure) provided in the L-shaped member 501. Specifically, in the L-shaped member 501, the spring attaching section (not shown in the figure) for attaching one end of the spring 206 is prepared. On the sidewall 120, the spring attaching section 503 for attaching the other end of the spring 206 is prepared.

In this modification, the spring 206 pulls the entire L-shaped member 501 in a direction for bringing the rotating member 202 into contact with the second end face 112*b* of the label sheet 112. The contact surface 209 of the rotating member 202 provided on a free end side of the L-shaped member 501 presses the second end face 112*b* and regulates the movement in the width direction of the label sheet 112. Therefore, the L-shaped member 501 according to this modification functions as a contact body together with the rotating member 202 and can prevent a skew of roll paper with a small number of components.

Obviously, numerous modifications and variations of the present invention are possible in light of the above teachings. It is therefore to be understood that within the scope of the appended claims, the invention may be practiced otherwise than as specifically described herein.

What is claimed is:

1. A printer comprising:

a sheet holding unit configured to have a reference plane for positioning a first end face of roll paper and rotatably hold the roll paper according to an end face reference by the reference plane;

a conveying unit configured to draw out the roll paper held by the sheet holding unit and guide and convey the roll paper along a predetermined guide path;

a printing unit configured to apply printing based on print data to the roll paper guided and conveyed through the guide path;

a contact body configured to have a contact section and to be rotatably provided with the contact section located on a free end side, the contact section coming into contact with a second end face of the roll paper held by the sheet holding unit; and an urging unit configured to urge the contact body in a first rotating direction for bringing the contact section close to the second end face of the roll paper and bring the contact section into contact with the second end face to bring the first end face of the roll paper into contact with the reference plane, wherein the sheet holding unit includes:

a sheet holding shaft configured to project from the reference plane, cause a cylindrical paper pipe of the roll paper to be inserted thereover, and hold the roll paper; and a slide holding mechanism configured to allow the sheet holding shaft to slide between an upper position and a lower position and hold the sheet holding shaft in one of the upper position and the lower position.

2. The printer of claim 1, wherein the contact body is attached to the free end side to be displaced by rotating in a first rotating direction and interfering with the second end face of the roll paper and has an interference body forming the contact section in an area set in contact with the second end face, wherein the sheet holding unit includes a posture changing mechanism configured to set the interference body in a first posture for bringing the interference body into contact with an end face, which is at an opposite side of the reference plane, of the paper pipe of the roll paper held by the sheet holding shaft positioned in the upper position or a second posture for bringing the interference body into contact with the end face of the paper pipe of the roll paper held by the sheet holding shaft positioned in the lower position and hold the interference body on a free end side of the contact body.

3. The printer of claim 2, wherein the posture changing mechanism includes an attaching structure for detachably attaching the interference body to an area on the free end side of the contact body in a state in which the interference body is vertically reversed to be set in the first posture or the second posture.

4. The printer of claim 2, further comprising a first arm projecting from the reference plane to a side on which the roll paper is located by the sheet holding unit, wherein the contact body is a second arm supported at a support point O rotatably with respect to the first arm, the urging unit is a spring, one end of which is located at a predetermined point X and the other end of which is connected to the second arm at a connection point Y, and the printer further comprises a holding mechanism provided in at least one of the first arm and the second arm and configured to hold, in a position where angle XOY=predetermined angle $\alpha$ ($\alpha$>180°), the second arm rotationally displaced to a position where angle XOY>180° in a second rotating direction opposite to the first rotating direction by external force and further pulled in the second rotating direction by the spring.

5. The printer of claim 4, wherein the predetermined point X and the connection point Y are set in positions where the spring urges the second arm such that the contact section pushes the second end face of the roll paper with fixed pressing force.

6. The printer of claim 1, wherein the contact section is a distal end section on the free end side of the contact body formed with roundness for sliding the second end face of the roll paper.

7. The printer of claim 1, further comprising a first arm projecting from the reference plane to a side on which the roll paper is located by the sheet holding unit, wherein the contact body is a second arm supported at a support point O rotatably with respect to the first arm, the urging unit is a spring, one end of which is located at a predetermined point X and the other end of which is connected to the second arm at a connection point Y, and the printer further comprises a holding mechanism provided in at least one of the first arm and the second arm and configured to hold, in a position where angle XOY=predetermined angle $\alpha$ ($\alpha$>180°), the second arm rotationally displaced to a position where angle XOY>180° in a second rotating direction opposite to a first rotating direction by external force and further pulled in the second rotating direction by the spring.

8. The printer of claim 7, further comprising:

a housing;

a roll-paper storing unit configured to include at least the sheet holding unit, the contact body, and the urging unit and to be supported to be freely drawn out from and housed in the housing, wherein the holding mechanism causes, in a process for housing the roll-paper storing unit in the housing, the second arm to interfere with the housing, and locates and holds the second arm in a position rotating in the first rotating direction.

9. The printer of claim 8, wherein the predetermined point X and the connection point Y are set in positions where the spring urges the second arm such that the contact section pushes the second end face of the roll paper with fixed pressing force.

10. The printer of claim 7, wherein the predetermined point X and the connection point Y are set in positions where the spring urges the second arm such that the contact section pushes the second end face of the roll paper with fixed pressing force.

11. A printer comprising:

a sheet holding unit configured to have a reference plane for positioning a first end face of roll paper and rotatably hold the roll paper according to an end face reference by the reference plane;

a conveying unit configured to draw out the roll paper held by the sheet holding unit, and guide and convey the roll paper along a predetermined guide, path;

a printing unit configured to apply printing based on print data to the roll paper guided and conveyed through the predetermined guide path;

a contact body configured to have a contact section and to be rotatably provided with the contact section located on a free end side, the contact section coming into contact with a second end face of the roll paper held by the sheet holding unit;

an urging unit configured to urge the contact body in a first rotating direction for bringing the contact section close to the second end face of the roll paper and bring the contact section into contact with the second end face to bring the first end face of the roll paper into contact with the reference plane; and a first arm projecting from the reference plane to a side on which the roll paper is located by the sheet holding unit, wherein the contact body is a second arm supported at a support point O rotatably with respect to the first arm, the urging unit is a spring, one end of which is located at a predetermined point X and the other end of which is connected to the second arm at a connection point Y, and the printer further comprises a holding mechanism provided in at least one of the first arm and the second arm, and configured to hold, in a position where angle XOY=predetermined angle $\alpha$ ($\alpha$>180°), the second arm rotationally displaced to a position where angle XOY>180° in a second rotating direction opposite to a first rotating direction by external force and further pulled in the second rotating direction by the spring.

12. The printer of claim 11, wherein the contact section is a distal end section on the free end side of the contact body formed with roundness for sliding the second end face of the roll paper.

13. The printer of claim 11, further comprising:

a housing;

a roll-paper storing unit configured to include at least the sheet holding unit, the contact body, and the urging unit and to be supported to be freely drawn out from and housed in the housing, wherein the holding mechanism causes, in a process for housing the roll-paper storing unit in the housing, the second arm to interfere with the housing, and locates and holds the second arm in a position rotating in the first rotating direction.

14. The printer of claim 13, wherein the predetermined point X and the connection point Y are set in positions where the spring urges the second arm such that the contact section pushes the second end face of the roll paper with fixed pressing force.

* * * * *